United States Patent [19]

Ludwig

[11] Patent Number: 4,461,496

[45] Date of Patent: Jul. 24, 1984

[54] SOAP HAVING IMPROVED CARBONLESS IMAGING PROPERTIES

[75] Inventor: Willis J. Ludwig, St. Croix, Wis.

[73] Assignee: Minnesota Mining and Manufacturing Company, St. Paul, Minn.

[21] Appl. No.: 408,798

[22] Filed: Aug. 17, 1982

[51] Int. Cl.[3] ..... B41M 5/16; B41M 5/22

[52] U.S. Cl. ..... 346/210; 106/14.5; 106/21; 106/27; 106/28; 428/704; 428/914; 346/211; 346/212; 346/216; 346/217

[58] Field of Search ..... 282/27.5; 428/320.4–320.8, 411, 457, 464, 488, 537, 689, 697, 914; 106/14.5, 19, 22, 23, 25, 27, 28, 21, 31; 427/150, 151

[56] References Cited

U.S. PATENT DOCUMENTS

| | | | |
|---|---|---|---|
| 2,663,654 | 12/1953 | Miller et al. | 117/36 |
| 2,910,377 | 10/1959 | Owen | 117/36 |
| 3,481,759 | 12/1969 | Ostlie | 117/36.2 |
| 3,682,684 | 8/1972 | Newman et al. | 117/36.9 |
| 4,111,462 | 9/1978 | Lange et al. | 282/27.5 |

*Primary Examiner*—Bruce H. Hess

*Attorney, Agent, or Firm*—Donald M. Sell; James A. Smith; David L. Weinstein

[57] ABSTRACT

Soap composition having improved imaging properties. The composition comprises (1) at least one metal cation which produces an image when reacted with by a dye precursor which is a derivative of dithiooxamide, (2) at least one rosin soap, and (3) at least one metallic soap. The presence of the metallic soap results in a higher level of metal cation available for image formation, thus improving speed of image formation and image quality.

18 Claims, No Drawings

SOAP HAVING IMPROVED CARBONLESS IMAGING PROPERTIES

BACKGROUND OF THE DISCLOSURE

This invention relates to an imaging composition for providing improvement in imaging speed and image quality. More specifically, it is related to soaps having metal cations which produce images when reacted with certain dye precursors.

It is well known that dark images or visibly colored images can be formed on various substrates without the use use of carbon by methods which provide for the reaction of rosin soaps of nickel or iron with dye precursor metal chelating materials such as dithiooxamide chelating agents. These chelating agents operate to form colored complexes with the transition metal cations. By applying rosin soaps of nickel or iron to a substrate, blue-purple images can be formed on the substrate by contacting the substrate with dithiooxamide dye precursors.

A particularly useful application of rosin soaps is in the formation of "carbonless" papers. Impact or pressure-sensitive self-marking carbonless papers are well known materials which have been in commercial use for many years. Ordinarily, these papers are printed and collated into form sets for producing multiple copies. Impact on the copy sheet causes each of the remaining underlying sheets to form a mark thereon corresponding to the mark applied by machine key or stylus on the top sheet without carbon paper interleaves or carbon coatings. of course, this sequence can be carried out through a number of sheets just as if carbon paper were used. The top sheet of paper upon which the impact is immediately made usually has its back surface coated with microscopic capsules containing one of the ingredients which reacts to produce a mark. A receiver sheet, placed in contact with such back surface of the top sheet has its front surface coated with a material having a complementary component reactive with the contents of the capsules so that when capsules are ruptured by stylus or machine key pressure the contents of the ruptured capsules react with a coreactant therefor on the receiver sheet and the mark forms corresponding to the mark impressed by the stylus or machine key. In the trade, these self-marking impact transfer papers are designated by the terms CB, CFB, and CF, which stand respectively for "coated back," "coated front and back," and "coated front." Thus, the CB sheet is usually the top sheet and the one on which the impact impression is directly made; the CFB sheets are the intermediate sheets which form a mark on the front surface thereof and transmit the contents of ruptured capsules from the back surface thereof to the front of the next succeeding sheet; the CF sheet is the last sheet used which is only coated on the front surface to form an image thereon and is not coated on the back surface as no further transfer is desired. While it is customary to coat the capsules on the back surface and coat the coreactant for the capsules on the front surface, this procedure could be reversed if desired.

Yet another type of self-marking carbonless paper is referred to as a self-contained paper. This term refers to paper having the front surface treated with a coating which contains both the colorless precursor, generally in encapsulated form, and a complementary color-forming reactant. Thus, when pressure is applied, again as by a typewriter or other writing instrument, the color precursor capsule is ruptured and reacts with the surrounding complementary coreactant to form a mark.

A presently preferred class of papers is made wherein the capsule coating is comprised of capsules having a liquid fill containing an N,N'-di-substituted dithiooxamide complexing agent as a dye precursor which complexes with a metal cation, which may be included in the form of a metal salt in the coating of the sheet material, to produce a vivid image. A particular N,N'-di-organo-substituted dithiooxamide used is a combination of N,N'-di-benzyl-dithiooxamide (hereinafter sometimes referred to as DBDTO) and N,N'-bis (2-octanoyl-oxyethyl) dithiooxamide (hereinafter called DO-EDTO). This material is usually present in an organic solvent such as cyclohexane within the capsule and is present in the amount of about 4% to 8% of the capsule fill.

A particularly preferred metal cation used is nickel. Nickel rosinate is often used as the active ingredient in the coating since it is substantially colorless and reacts rapidly with the dye precursor to form a blue purple image.

A shortcoming of nickel rosinate systems is the length of time required for an intense image to form after the application of pressure. Although an image formed with nickel rosinate has an acceptable optical density after a period of several minutes, users of carbonless paper generally prefer that such an image be formed in a shorter time.

SUMMARY OF THE INVENTION

This invention involves a composition for providing enhanced imaging properties. The composition comprises the reaction product of (a) at least one metal cation, (b) at least one rosin salt, and (c) at least one metallic soap which enhances the imaging properties of the metal cation. The metal cation of preference is $Ni^{++}$, and its source is preferably nickel acetate. The nickel cation may also be provided by nickel nitrate. The rosin salt is preferably sodium rosinate, which is the sodium salt of rosin. The metallic soap of preference is lithium stearate, but other metallic soaps which are also acceptable include water-insoluble compounds of alkaline earth or heavy metals combined with monobasic carboxylic acids having from 7 to 22 carbon atoms. Other conventional additives, such as a vehicle component, binder, and encapsulated color forming co-reactant may also be included in the composition. The composition can be applied to substrates by means of conventional coating techniques.

The imaging composition of this invention is able to provide an image within a period of a few seconds that has an intensity equivalent to that of images formed by conventional compositions after several minutes. The image formed by the composition is an intense blue-black color.

DETAILED DESCRIPTION

Prior to the discovery of the present invention, the preferred method of providing nickel cation for CB,CFB, CF or self-contained, self-marking impact transfer papers was by combining a salt of nickel and a salt of rosin. The preferred salt of nickel was nickel nitrate and the preferred salt of rosin was sodium rosinate. Rosins are composed of approximately 90% resin acids and 10% nonacidic material. Resin acids are monocarboxylic acids having the type molecular formula $C_{20}H_{30}O_2$. Salts of rosin are, in actuality, salts of resin acids contained in the rosin. Sodium rosinate, the sodium salt of rosin, is the preferred coreactant of nickel salt, i.e. nickel nitrate, for the formation of nickel rosinate. The term sodium resinate is also employed to refer to the sodium salt of rosin. The applicant has discovered that the addition of at least one metallic soap to a metal cation/sodium rosinate mixture significantly improves the imaging properties of the metal cation.

The metallic soaps useful herein are a group of water-insoluble compounds containing alkaline earth or heavy metals combined with monobasic carboxylic acids of 7 to 22 carbon atoms. Lithium, an alkali metal, forms soaps which are slightly water soluble and which are also classified as metallic soaps. They can be represented by the general formula $(RCOO)_xM$, where R is an aliphatic or alicyclic radical and M is a metal with valence x. Their water insolubility differentiates them from ordinary soap and their solubility or solvation in organic solvents accounts for their manifold uses.

A large number of metallic elements may be incorporated into the soaps suitable for use in this invention. The metallic soaps contemplated for this invention include Al, Ba, Ca, Cu, Co, Fe, Pb, Li, Mg, Mn, Zn, and Zr soaps.

The acid portion of the metallic soaps are derived from the naturally occurring long-chain monocarboxylic saturated and unsaturated fatty acids with 7 to 22 chain atoms, rosin acids, tall oil, naphthenic acids, 2-ethylhexoic acid, and the synthetic tertiary acids. Salts of acids with fewer than seven carbon atoms form soaps which are water soluble and are not included. Salts of the dicarboxylic organic acids produce products of low solubility and are not considered in the class of metallic soaps.

The preferred metallic soap for use in the present invention is lithium stearate. Lithium stearate may be present alone or as a component in a mixture, such as with lithium palmitate, lithium tallate, lithium laurate, and lithium oleate. Other metallic soaps which are suitable for the present invention include the stearates, palmitates, naphthenates, tallates, laurates, oleates, and 2-ethylhexoates of aluminum, calcium, copper, cobalt, iron, lead, magnesium, manganese, and zinc. These metallic soaps may be present alone or as a component in a mixture of metallic soaps.

As in the prior art, the nickel cation is the preferred metal cation for carbonless imaging. Nickel acetate is preferred over nickel nitrate as the source of nickel cation. Although the nickel cation is preferred, iron cations, i.e. $Fe^{++}$ and $Fe^{+++}$, are also suitable for carbonless imaging. Copper and cobalt may also be used. Mixtures of two or more sources of cations may be used. Also, more than one cation may be used in the composition. The preferred rosin salt is sodium rosinate. Although other rosin salts are acceptable, e.g. water soluble rosin salts, the sodium salt is readily available at a relatively low cost. Mixtures of rosin salts are also useful.

The liquid imaging agents or dye precursors used in the capsules of the present invention can be any of a number of the known colorless coreactant imaging compositions such as the dithiooxamide derivatives. A preferred liquid fill is a solution of imaging coreactant comprising dithiooxamide compound such as dibenzyl dithiooxamide (DBDTO) and dioctanoyloxyethyldithiooxamide (DOEDTO) or mixtures thereof, in an organic vehicle which is a solvent for the imaging coreactant, but which will not dissolve the capsule shell wall. Cyclohexane has been found to be an acceptable vehicle. Xylene, toluene, diethylphthalate, and tributyl phosphate are examples of other useful solvents. Tributyl phosphate and diethylphthalate are particularly useful materials to be used in the liquid capsule fill since they reduce volatility and increase the rate and efficiency of the image forming reaction.

The relative amounts of the various materials will vary. As a general rule it is desirable to provide as much imaging coreactant as can be dissolved in the vehicle while retaining sufficient fluidity of the liquid. Since the volatility of the vehicle should be low, additives such as tributyl phosphate and diethylphthalate are desirable since they are less volatile and improve imaging as noted above. A particularly preferred liquid imaging agent comprises, based on total weight, about 1-2% DBDTO, 4-30% DOEDTO, 15-35% tributylphosphate, 10-25% diethylphthalate and 8-70% cyclohexane.

The coating composition for receiver sheets for CB, CFB, and CF papers is prepared by mixing the following ingredients:

A. Components for forming the coreactant for the dye precursor, i.e. the source or sources of the metal cation and the source or sources of the rosinate anion;

B. Metallic soap.

If the composition is to be coated from an aqueous solution, water and a binder are also included in the mixture. Suitable binders include starches and latexes. The preferred binders are starches. Water, of course, acts as the vehicle for coating the composition onto the substrate. Other additives which may be included in the coating composition include (a) optical brighteners, (b) viscosity controllers, (c) image stabilizers, (d) scuff materials.

The coating composition for self-contained carbonless paper further includes an encapsulated dye precursor.

The composition for receiver sheets for CB, CFB, and CF papers and the composition for self-contained paper may be applied by means of conventional coating methods. The preferred method is blade coating.

The compositions of the present invention may also be applied to the paper sheet during the process of making the paper.

The composition of the present invention may be used on substrates other than paper, e.g., cloth, synthetic materials, etc., in order to form dark images or visibly colored images.

The following examples further illustrate the present invention. However, they should not be construed as limitative. All amounts are given in parts by weight unless otherwise indicated.

EXAMPLE I

Four compositions were prepared in order to compare the product of the present invention with those products currently used for carbonless imaging. Table I sets forth the ingredients in their respective amounts for the compositions to be compared:

TABLE I

| | Amount (Weight Percent) | | | |
|---|---|---|---|---|
| Ingredient | A | B | C | D |
| Nickel Nitrate | 36.5 | — | 21.6 | — |
| Nickel Acetate | — | 31.2 | — | 18.6 |

TABLE I-continued

| Ingredient | Amount (Weight Percent) A | B | C | D |
|---|---|---|---|---|
| Sodium Rosinate | 63.5 | 68.8 | 39.2 | 40.7 |
| Lithium Stearate | — | — | 39.2 | 40.7 |

Samples A and B represent products currently used for carbonless imaging. Samples C and D represent products of the present invention. In each case, aqueous solutions of the ingredients were mixed in a stainless steel kettle equipped with an agitator and cooling jacket at about 100° F. Agitation at this temperature was continued for one hour. The water was removed from the reaction product prior to the determination of the $Ni^{++}$ level of the product.

The first two properties compared were (a) $Ni^{++}$ level of the reaction product and (b) the nature of the reaction product. $Ni^{++}$ level is a measurement of the amount of nickel cation available for reaction with the dye precursor. The $Ni^{++}$ level was measured by means of spectrographic analysis. The nature of the product is an indicator of the relative speed with which the $Ni^{++}$ cation will react with the dye precursor. Soft, amorphous coatings tend to react more readily than hard, friable coatings.

The following Table sets forth the results of these comparisons:

TABLE

| Composition | $Ni^{++}$ Level (Percent) | Nature of Product |
|---|---|---|
| A | 4.62 | Hard, friable |
| B | 5.06 | Hard, friable |
| C | 5.50 | Soft, amorphous |
| D | 7.22 | Soft, amorphous |

From the foregoing Table, it can be seen that the preferred embodiment of the present invention, Sample D, results in a $Ni^{++}$ level that exceeds the $Ni^{++}$ level of a coating composition that is currently used in the art, i.e., Sample A, by approximately 56 percent. Imaging speed is directly proportional to $Ni^{++}$ level of the coating. It can also be seen that the compositions of the present invention, as produced in Samples C and D, are soft and amorphous, whereas the coating composition that is currently used in the art, i.e. Sample A, is hard and friable. While not wishing to be bound by any theory, it is believed that an amorphous nature is a key factor in promoting an increase in imaging speed in that the amorphous material dissolves more readily in the solvent which contains the dye precursor, thus allowing the $Ni^{++}$ to react more rapidly with the dye precursor.

EXAMPLE II

Three samples were prepared in order to compare the imaging qualities of the product of the present invention with those of products currently used in the art. Table II sets forth the ingredients in their respective amounts for the compositions to be compared:

TABLE II

| Ingredient | Amount (lbs) E | F | G |
|---|---|---|---|
| Starch[1] | 1510 | 1510 | 1510 |
| Water | 1019 | 1019 | 1019 |
| Optical Brightener[2] | 55 | 55 | 55 |
| Sodium Alginate | 18 | 18 | 18 |
| Lithium Stearate[3] | — | — | 100 |

TABLE II-continued

| Ingredient | Amount (lbs) E | F | G |
|---|---|---|---|
| Sodium Rosinate[4] | 100 | 100 | 100 |
| Thiourea | 33 | 33 | 33 |
| Starch[5] | 800 | 800 | 800 |
| Rinse Water | 50 | 50 | 50 |
| Nickel Nitrate | 46 | — | — |
| Nickel Acetate | — | 46 | 46 |
| Capsules[6] | 4932 | 4932 | 4932 |
| Bisphenol A Solution[7] | 460 | 460 | 460 |

[1]32% aqueous solution of cooked ethylated corn starch.
[2]"Leucophor", manufactured by Ciba-Geigy Corp.
[3]Lithium Stearate Type FS, manufactured by Witco Chemical Corporation.
[4]Dry X Rosin, manufactured by Hercules Incorporated.
[5]Clinton 105-A "M" Starch, uncooked starch manufactured by Clinton Corn Processing Co. This acts to reduce breakage of the capsules.
[6]The capsules were prepared in accordance with Matson, U.S. Pat. Nos. 3,516,846 and 3,516,941, which are hereby incorporated by reference. (See Example 18 in each for method of preparation.) 64% of the capsule charge is water.
[7]58% aqueous dispersion of Bisphenol A.

The materials were mixed in their order of recitation above in a stainless steel kettle equipped with an agitator and cooling jacket at about 140° F. After the temperature of the batch reached 100° F., the agitation was continued at this temperature for 1 hour.

The coating weight, 4 Second Image, and Ultimate Image were measured for each sample. 4 Second Image measures the percent reflectance of the image 4 seconds after the impression is made on the carbonless paper. Ultimate Image measures the maximum percent reflectance of the image on the carbonless paper.

The following Table sets forth the imaging results of samples:

TABLE III

| Sample | Coating Wt. (lbs/1300 sq. ft) | 4 Second Image | Ultimate Image |
|---|---|---|---|
| E | 3.3 | 42.0 | 25.0 |
| F | 1.9 | 36.6 | 19.8 |
| G | 1.9 | 23.4 | 13.4 |

The image scale ranges from 0 to 100. The lower the reading, the lower the percent reflectance, and consequently, the darker the image. The images were measured on a Photovolt Reflection Meter, Model 610, manufactured by Photovolt Corporation, New York, N.Y. From the results of Table III, it can be seen that Sample G, which contains lithium stearate, is superior to Samples E and F, in which lithium stearate is absent.

It has been found that the optimum weight ratio of lithium stearate to nickel acetate is 2.2 to 1.0. The optimum weight ratio of sodium rosinate to nickel acetate is also 2.2 to 1.0. The suitable percentage ranges (by weight) for nickel acetate, sodium rosinate, and lithium stearate are set forth in the following Table:

TABLE IV

| | Suitable Range, Percent (Dry Weight) |
|---|---|
| Nickel Acetate | 12.7 to 34.1 |
| Sodium Rosinate | 25.3 to 68.2 |
| Lithium Stearate | 17.7 to 77.3 |

The values in the foregoing Table do not take into account the binder, water, capsules, and other additives present in the coating mixture.

What is claimed is:

1. Imaging composition comprising the reaction product of (1) at least one metal cation which can provide a visibly colored image when reacted with a dye precursor which is a derivative of dithiooxamide (2) at least one rosin salt, and (3) at least one water-insoluble compound containing lithium combined with a monocarboxylic acid of 7 to 22 carbon atoms.

2. Imaging composition according to claim 1 wherein the metal cation is selected from the group consisting of nickel, iron, copper and cobalt.

3. Imaging composition according to claim 1 wherein said at least one water-insoluble compound is lithium stearate.

4. A multisheet form comprising a first sheet having on the reverse surface a color forming component, and underlying said first sheet, a second sheet having at least a portion of the obverse surface coated with the imaging composition of claims 1, 2, or 3.

5. Imaging composition according to claim 1 and including a binder and a vehicle for applying the composition onto a substrate.

6. Imaging composition according to claim 5 wherein the binder is starch.

7. Imaging composition according to claim 5 wherein the application vehicle is water.

8. Imaging composition according to claim 5 and further including an encapsulated color forming coreactant.

9. Carbonless sheet having at least a portion of one major surface thereof carrying an imaging composition according to claim 1.

10. The carbonless sheet of claim 9 wherein the sheet is made of paper.

11. Carbonless paper sheet according to claim 10 wherein the metal cation is selected from nickel or iron.

12. Carbonless paper sheet according to claim 10 wherein said at least one water-insoluble compound is lithium stearate.

13. Carbonless paper sheet according to claim 10 and including an encapsulated color forming coreactant.

14. Carbonless paper sheet according to claim 13 wherein the encapsulated color forming coreactant is a derivative of dithiooxamide.

15. Imaging composition useful for applying to a substrate to provide a pressure sensitive carbonless imaging sheet comprising:

A. the reaction product of
  (1) at least one metal cation which produces an image wen reacted upon by a dye precursor which is a derivative of dithiooxamide,
  (2) at least one rosin salt, and
  (3) at least one water-insoluble compound containing lithium combined with a monocarboxylic acid of 7 to 22 carbon atoms;

B. binder;

C. encapsulated color forming derivative of dithiooxamide;

D. vehicle for applying the composition to the imaging sheet.

16. Imaging composition of claim 15 wherein the metal cation is nickel, the rosin salt is sodium rosinate, the water-insoluble compound is lithium stearate, the binder is starch, the application vehicle is water and the dithiooxamide derivative is an N,N'-di-organo-substituted dithiooxamide.

17. Imaging composition of claim 16 wherein the source of nickel cation is nickel acetate, the rosin salt is sodium rosinate, and the water-insoluble compound is lithium stearate.

18. Imaging composition of claim 17 wherein the reaction product of nickel acetate, sodium rosinate, and lithium stearate is formed by reacting from about 12.7 weight percent to about 34.1 weight percent nickel acetate, from about 25.3 weight percent to about 68.2 weight percent sodium rosinate, and from about 17.7 weight percent to about 77.3 weight percent lithium stearate.

* * * * *